US005139166A

United States Patent [19]

Smith

[11] Patent Number: 5,139,166

[45] Date of Patent: Aug. 18, 1992

[54] CONTAINER INCLUDING PLATE WITH DRAIN INSERT

[76] Inventor: Sharon L. Smith, 1117 Nunes Ct., Manteca, Calif. 95336

[21] Appl. No.: 775,746

[22] Filed: Oct. 15, 1991

[51] Int. Cl.[5] ..... B65D 25/00

[52] U.S. Cl. ..... 220/574; 220/23.83; D7/505; D7/667

[58] Field of Search ..... 220/571, 572, 574, 912, 220/23.83, 23.86, 575; 206/508; D7/667, 505

[56] References Cited

U.S. PATENT DOCUMENTS

| | | | |
|---|---|---|---|
| D. 105,367 | 7/1937 | Swordling | 220/575 X |
| D. 131,150 | 1/1942 | Swofford | 220/574 X |
| D. 314,119 | 1/1991 | Kauffman | D7/505 |
| 2,650,485 | 9/1953 | Greca | 220/23.83 |
| 2,660,040 | 11/1953 | Babski | 220/23.83 |
| 3,009,599 | 11/1961 | Schier et al. | 220/574 |
| 3,989,158 | 11/1976 | Florian | 220/574 X |
| 4,147,277 | 4/1979 | Bateman et al. | 220/575 X |
| 4,892,213 | 1/1990 | Mason, Jr. | 206/508 X |

*Primary Examiner*—Steven M. Pollard
*Attorney, Agent, or Firm*—Thomas R. Lampe

[57] ABSTRACT

Apparatus for holding, stabilizing, and draining watermelon or other foodstuff including a receptacle and a support member for the watermelon or other foodstuff positionable on the receptacle. The support member has drain holes formed therein and rib elements which project upwardly to support the watermelon or other foodstuff in position above the drain holes so that they are not plugged.

5 Claims, 3 Drawing Sheets

CONTAINER INCLUDING PLATE WITH DRAIN INSERT

TECHNICAL FIELD

This invention relates to a plate with drain insert. More particularly, the apparatus of the present invention is for the purpose of holding, stabilizing, and draining watermelon or other foodstuffs while permitting ready access thereto by a person consuming same.

BACKGROUND ART

My U.S. Des. Pat. No. 314,119, issued Jan. 29, 1991, discloses a design for a watermelon plate featuring a receptacle and a support member positionable on the receptacle. The support member is for the purpose of presenting the watermelon for consumption by a consumer. The support member has a concave bottom wall in which apertures are formed to permit drainage of liquid from the watermelon or the like.

In such device, however, the apertures can be plugged by the watermelon. Consequently, the consumer may find that the watermelon he or she is eating is immersed in its own juice or liquid as is the case with ordinary plates. Furthermore, the watermelon is essentially free to move about on the upwardly disposed surface of the support member. Thus, the person eating the watermelon may have to hold it with one hand while applying a fork or other eating utensil thereto with the other.

DISCLOSURE OF INVENTION

The present invention also relates to apparatus in the form of containers for holding watermelon or other foodstuffs. However, with the arrangement disclosed herein, the watermelon or the like is supported above the drain holes or apertures of the apparatus so that they are not plugged and can perform their desired drainage function. Furthermore, the structure of the present apparatus holds and stabilizes the watermelon or other foodstuff during consumption thereof.

The present invention includes a receptacle defining an interior and an upper opening communicating with the interior.

A support member of a specified character is positionable on the receptacle and over the upper opening thereof. The support member is for the purpose of supporting the watermelon or other foodstuff and presenting same for consumption by a consumer.

The support member includes a bottom wall having a concave, upwardly disposed surface and defining a plurality of apertures leading from the concave, upwardly disposed surface to the receptacle interior when the support member is positioned on the receptacle.

The support member additionally includes a plurality of rib elements connected to and projecting upwardly from the bottom wall. The rib elements maintain at least some of the watermelon or other foodstuff supported by the support member above and out of engagement with the bottom wall and apertures whereby drainage of liquid from the watermelon or other foodstuff through the apertures is facilitated.

The rib elements are disposed in a radial pattern with the rib elements diverging away from one another as the rib elements radiate outwardly from a generally central location on the bottom wall. At least one aperture is located between each rib element and adjacent rib elements positioned on opposed sides thereof.

The rib elements are discrete and separate from one another, each of the rib elements having an inner end and an outer end, the rib element inner ends being separated and closely adjacent to each other at the bottom wall generally central location. The bottom wall defines an aperture at the generally central location and the rib elements converge toward the aperture at the generally central location.

Other features, advantages, and objects of the present invention will become apparent with reference to the following description and accompanying drawings.

BEST MODE FOR CARRYING OUT THE INVENTION

Figure 1:
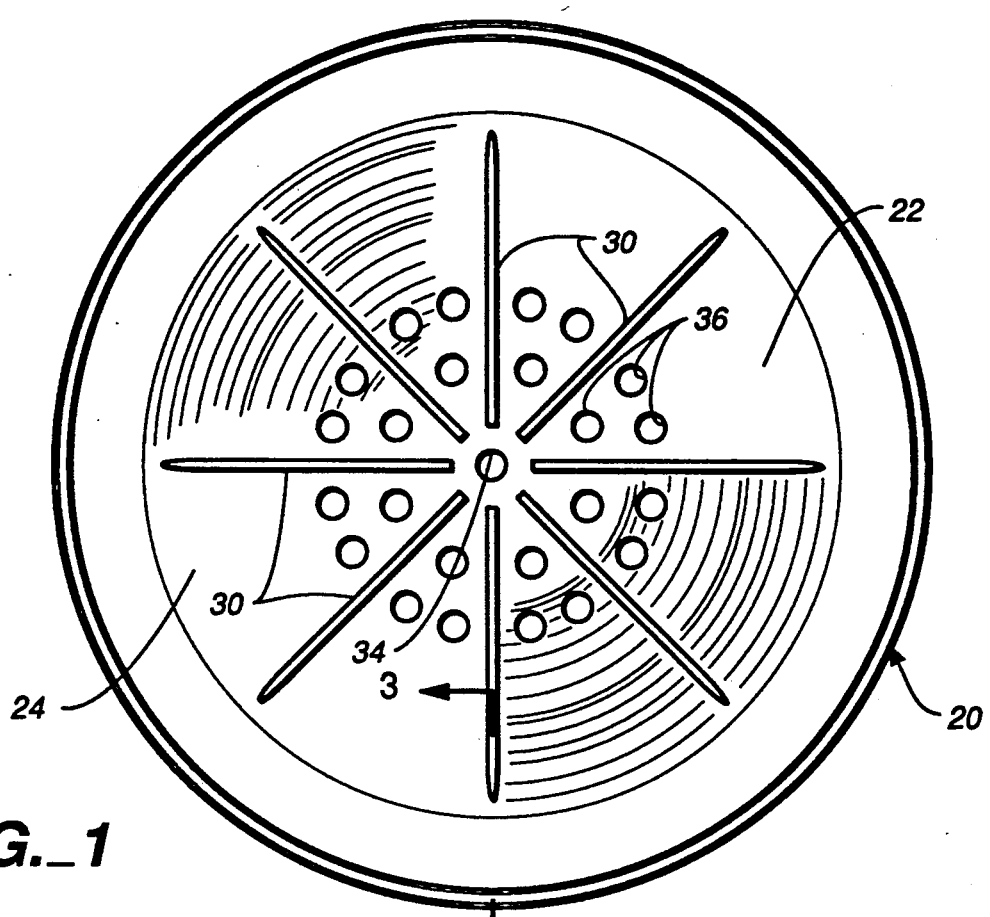
FIG. 1 is a plan view of a preferred form of support member utilizing the teachings of the present invention.
Figure 2:
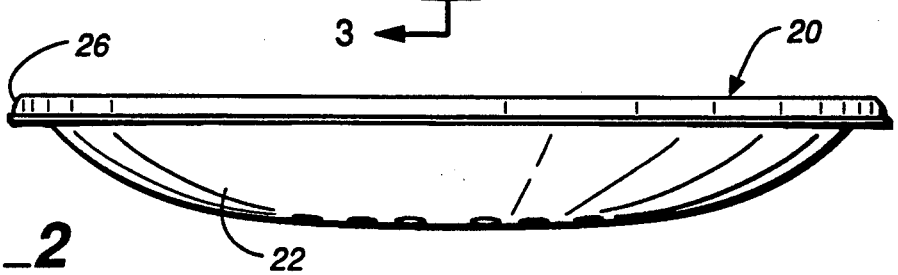
FIG. 2 is a side, elevational view of the support member.
Figure 3:
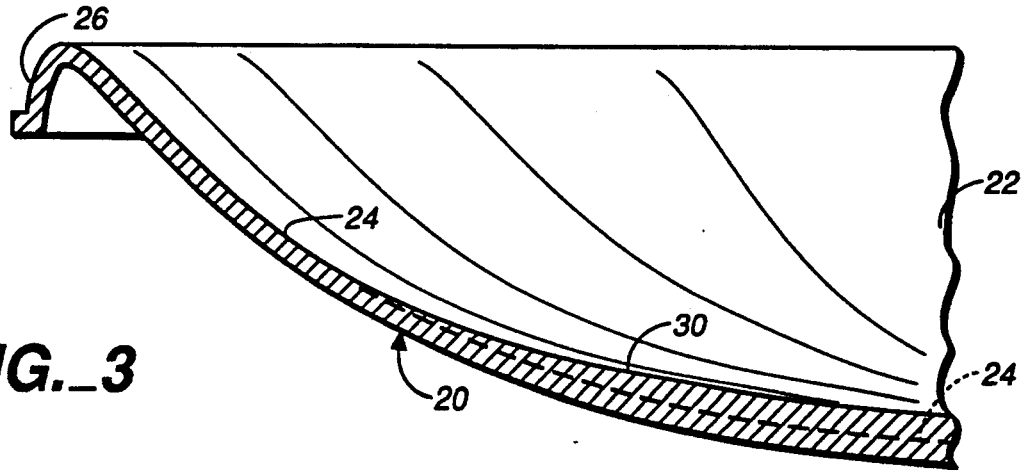
FIG. 3 is an enlarged, side, sectional view of that portion of the support member taken along the line 3—3 in FIG. 1.

Referring now to FIGS. 1-3 and 5, such figures illustrate a preferred form of container apparatus constructed in accordance with the teachings of the present invention. The apparatus includes a receptacle 10 (FIG. 5) defining an interior and having an upper opening 12 communicating with the interior thereof. The receptacle 10, as shown, is identical to that disclosed in U.S. Des. Pat. No. 314,119, noted above.

A support member 20 is positionable on the receptacle and over the upper opening thereof. The support member 20 is for the purpose of supporting watermelon or other foodstuff (not shown) and presenting same for consumption by a consumer.

The support member 20 includes a bottom wall 22 having a concave, upwardly disposed surface 24. The bottom wall defines a plurality of apertures leading from the concave, upwardly disposed surface 24 to the interior of receptacle 10 when the support member is positioned on the receptacle. The support member 20 has a lip 26 thereon which overlies the receptacle rim in a well known manner to retain the support member on the receptacle.

The support member additionally includes a plurality of rib elements 30 connected to and projecting upwardly from the bottom wall 22. In the arrangement shown, the rib elements are eight in number. However, the number of rib elements may be varied. The rib elements 30 are disposed in a radial pattern with the rib elements diverging away from one another as the rib elements radiate outwardly from a central location on the bottom wall at which aperture or drain hole 34 is located. In addition, apertures or drain holes 36 are defined by the bottom wall 22. In the arrangement illustrated, there are three apertures 36 located between each rib element and adjacent rib elements positioned on opposed sides thereof.

The apertures 34 and 36 are for the purposes of draining juice or liquid from watermelon or other foodstuff positioned on support member 20. The rib elements 30 perform the functions of supporting and stabilizing the watermelon or other foodstuff and maintaining same above and out of engagement with the bottom wall 22 and the apertures 34, 36, whereby the apertures will not be plugged and drainage of liquid from the watermelon or other foodstuff through the apertures is facilitated.

Any of the liquid not passing through the apertures 36 will be directed toward aperture 34 which, as stated above, is centrally located at the bottom wall. Because of the generally concave shape of the bottom wall, aperture 34 is at the lowermost point of the bottom wall.

Figure 4:
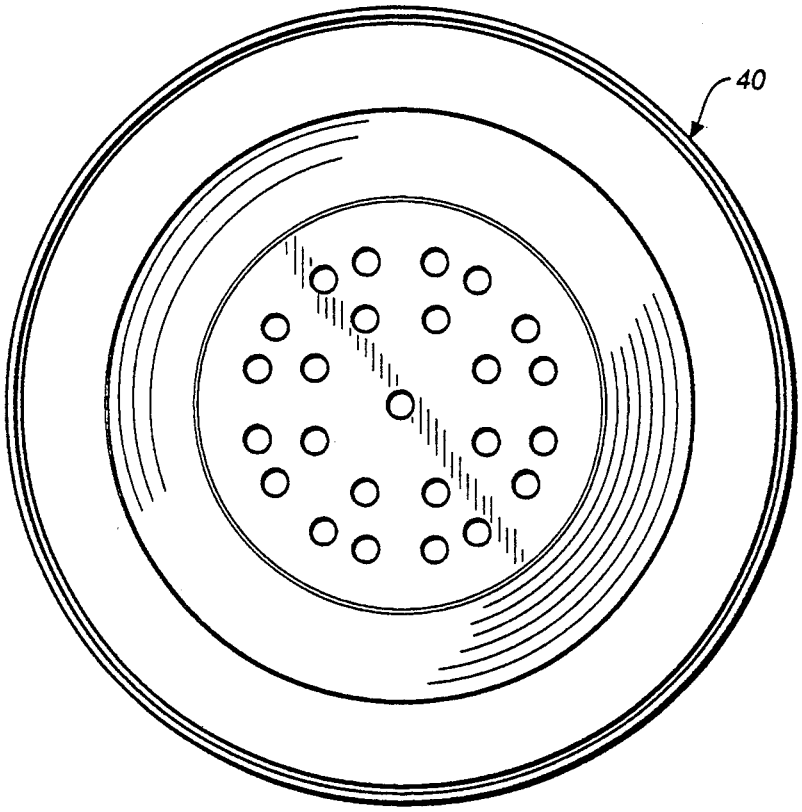
FIG. 4 (PRIOR ART)
FIG. 4 is a plan view of a support member of the type shown in the prior art.
Figure 5:
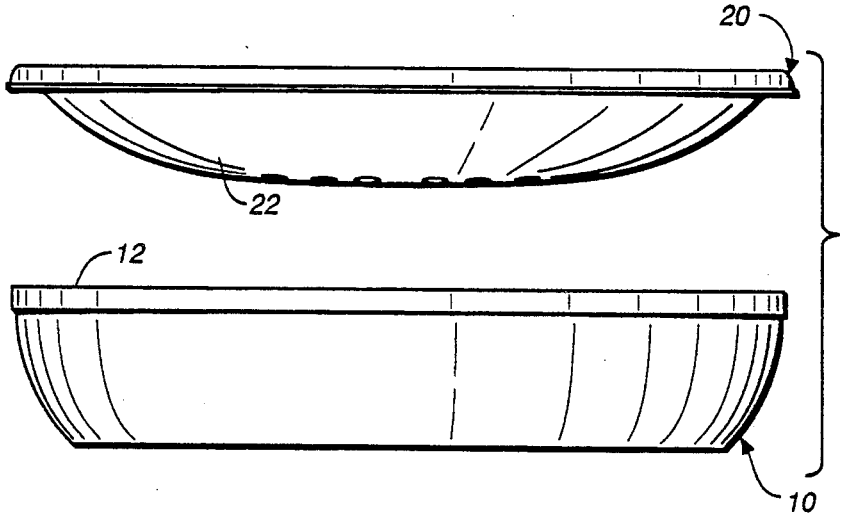
FIG. 5 is an exploded, side view showing the support member of the present invention disposed over a receptacle prior to positioning thereon.

In addition to promoting drainage, the rib elements prevent, or at least deter against, sliding of the watermelon or other foodstuff relative to the support member. In the prior art arrangement of FIG. 4, both drainage and foodstuff stabilization relative to the support member 40 is a problem as indicated above.

Figure 6:
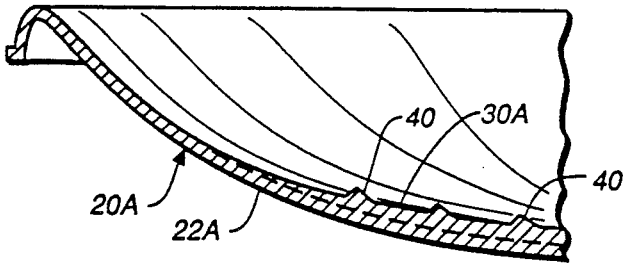
FIG. 6 is a view similar to FIG. 3, reduced in size as to compared to the depiction in FIG. 3, and disclosing a portion of an alternative embodiment support member.

Referring now to FIG. 6, an alternative form of apparatus constructed in accordance with the teachings of the present invention is illustrated. The only difference between this embodiment and the embodiment illustrated in FIGS. 1–3 and 5 is that the rib elements 30A of the alternative embodiment have barbs 40 spaced from one another and disposed along the length thereof. Barbs 40 function as holder elements which pierce the watermelon or other food stuff being retained on the rib elements and contribute to the stabilization thereof within the support member.

Figure 7:
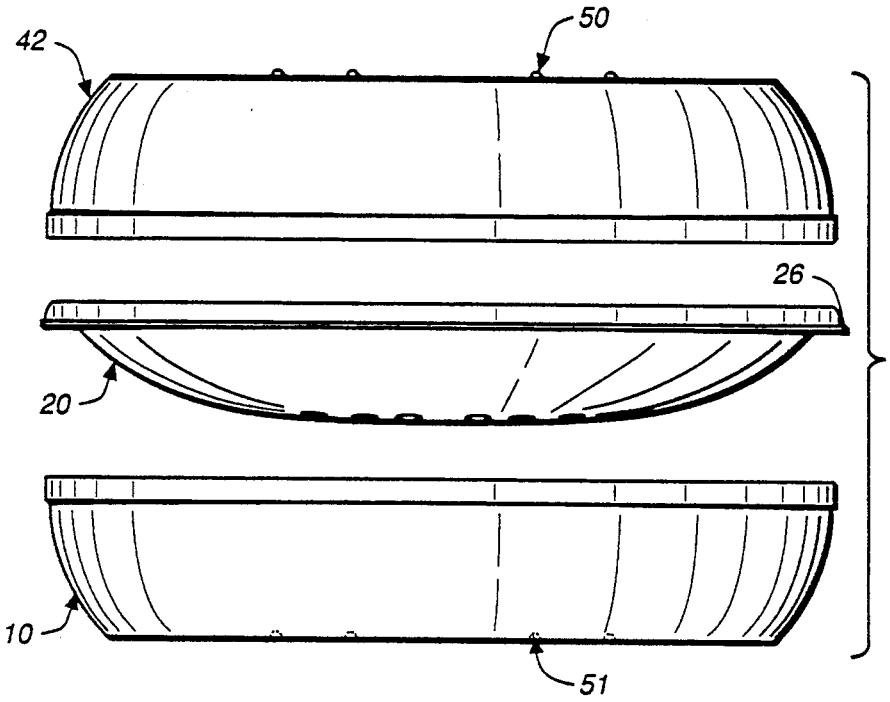
FIG. 7 is an exploded view illustrating a cover and its relationship to a support member and receptacle prior to assembly thereof.
Figure 8:
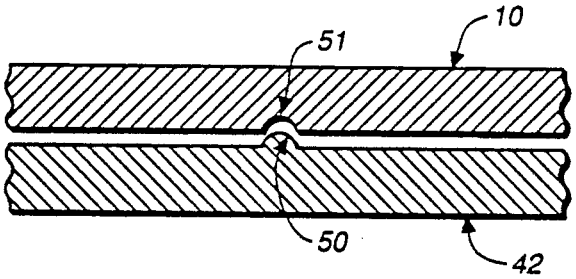
FIG. 8 is a greatly enlarged cross-sectional view of portions of the cover and receptacle of adjacent apparatus when stacked.
Figure 9:
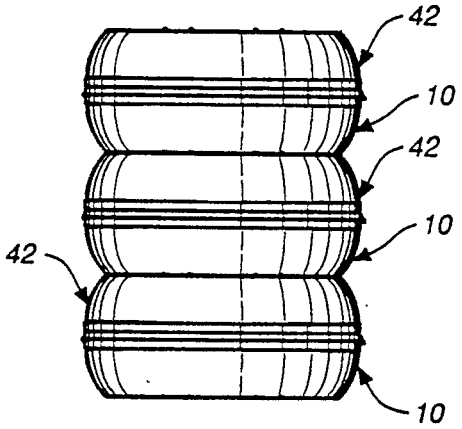
FIG. 9 is an elevational view showing containers in stacked condition.

FIGS. 7–8 show the incorporation of a cover 42 in the apparatus, the cover being positionable over and in engagement with lip 26 of support member 20 to retain the cover thereon. The cover has detents 50 formed thereon which enter corresponding indents 51 formed in the bottom of receptacle 10 whereby several of the containers may be maintained in alignment when stacked as shown in FIG. 9.

What is claimed is:

1. Container apparatus for holding, stabilizing, and draining watermelon or other foodstuff, said apparatus comprising in combination:

a receptacle defining an interior and an upper opening communicating with said interior; and a support member positionable on said receptacle and over the upper opening thereof, said support member for the purpose of supporting said watermelon or other foodstuff and presenting same for consumption by a consumer, said support member including a bottom wall having a concave, upwardly disposed surface and defining a plurality of apertures leading from said concave, upwardly disposed surface to said receptacle interior when said support member is positioned on said receptacle, and said support member additionally including a plurality of rib elements connected to and projecting upwardly from said bottom wall, said rib elements maintaining at least some of said watermelon or other foodstuff supported by said support member above and out of engagement with said bottom wall and apertures whereby drainage of liquid from said watermelon or other foodstuff through said apertures is facilitated, said rib elements being disposed in a radial pattern with said rib elements diverging away from one another as said rib elements radiate outwardly from a generally central location on said bottom wall, said generally central location being at the lowermost point of said bottom wall, at least one aperture being located between each said rib element and adjacent rib elements positioned on opposed sides thereof, said rib elements being discrete and separate from one another, each of said rib elements having an inner end and an outer end, and said rib element inner ends being separated and closely adjacent to each other at said bottom wall generally central location, said bottom wall defining an aperture at said generally central location, and said rib elements converging toward the aperture at said generally central location to direct liquid from said watermelon or other foodstuff toward the aperture at said generally central location whereby said liquid will drain through said aperture at said generally central location and through the apertures located between the rib elements.

2. The apparatus according to claim 1 wherein at least some of said rib elements have discrete, spaced holder elements projecting upwardly therefrom to pierce said watermelon or other foodstuff positioned on said rib elements to resist movement of said watermelon or other foodstuff relative to said rib elements.

3. The apparatus according to claim 2 wherein said holder elements are barbs.

4. The apparatus according to claim 1 additionally comprising a cover positionable over said support member.

5. The apparatus according to claim 4 wherein said cover and said receptacle incorporate means for maintaining adjacent covers and receptacles in stacked alignment.

* * * * *